United States Patent [19]

Coster

[11] 4,061,339

[45] Dec. 6, 1977

[54] MOVABLE PUZZLE

[75] Inventor: Theo Maurice Simon Coster, Tel Baruch, Israel

[73] Assignee: Or Da Industries Ltd., Israel

[21] Appl. No.: 694,958

[22] Filed: June 11, 1976

[30] Foreign Application Priority Data

Sept. 25, 1975 Israel ..... 48178

[51] Int. Cl.[2] ..... A63F 9/12

[52] U.S. Cl. ..... 273/157 R; 46/223

[58] Field of Search ..... 273/157 R; 46/201, 223

[56] References Cited

U.S. PATENT DOCUMENTS

| | | | |
|---|---|---|---|
| 1,230,263 | 6/1917 | Alexander | 273/157 UX |
| 1,321,109 | 11/1919 | Lasares | 273/157 UX |
| 1,565,880 | 12/1925 | Wilder | 46/223 UX |
| 2,510,884 | 6/1950 | Greene | 273/157 X |
| 2,680,306 | 6/1954 | Moyer | 35/70 X |
| 3,484,986 | 12/1969 | La Branche et al. | 46/201 |

*Primary Examiner*—Anton O. Oechsle

*Attorney, Agent, or Firm*—Weingarten, Maxham & Schurgin

[57] ABSTRACT

A movable puzzle comprising a plurality of puzzle elements having a substantially planar configuration which together form a completed image on at least one planar face when juxtaposed in a desired relative generally planar orientation. The puzzle pieces are arranged in upstanding completed image orientation in a trough having wheels mounted thereon in desired juxtaposition and spatial relationship so as to permit movement of the puzzle pieces as a whole.

7 Claims, 2 Drawing Figures

MOVABLE PUZZLE

Figure 1:
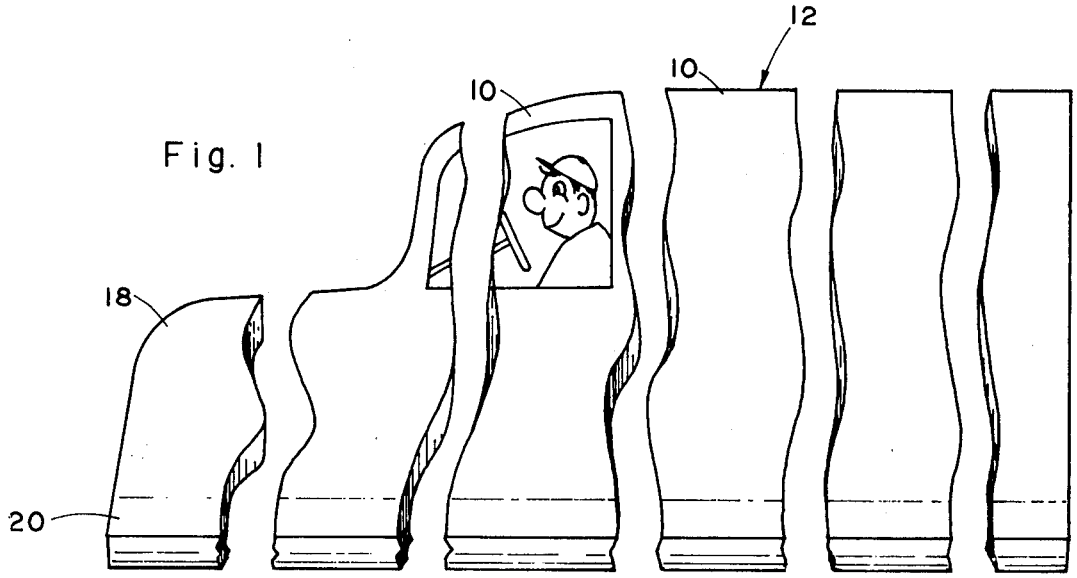

The present invention relates to children's toys and more particularly concerns essentially bi-dimensional puzzles which may be held together by a mounting member which permits movement of the puzzle as a whole.

Various types of movable block arrangements are known in the art. U.S. Pat. No. 2,092,687 shows a train formed of removably disposed blocks. The blocks are arranged between two parallel disposed rails formed on a base member having wheels attached thereto. U.S. Pat. No. 3,224,135 shows another type of block train in which the blocks are secured onto the base by socket type connectors. U.S. Pat. No. 1,579,884 shows a further type of wheeled block toy.

As distinct from the prior art devices which essentially comprise blocks and a mounting member therefor, the present invention provides a movable mounting and support for substantially planar puzzle elements.

In accordance with the present invention there is provided a movable puzzle comprising:

a plurality of puzzle elements each having top and bottom portion and having a substantially planar configuration and length and height dimensions substantially greater than its thickness and together forming a completed image on at least one planar face of the top portion thereof when juxtaposed in a desired relative generally planar orientation;

means for mounting said puzzle pieces in upstanding orientation and in desired juxtaposition and spatial relationship so as to permit movement of the puzzle pieces as a whole, said means including:

an elongate trough formed of generally parallel disposed first and second side members spaced apart separated by a distance approximately equal to the thickness of the planar puzzle pieces, and end pieces joining said side members to define a trough length approximately equal to the overall length of the bottom portions of the juxtaposed puzzle pieces, said trough being operative to provide upright support and maintenance in juxtaposition of said puzzle pieces inserted therein; and translation means permitting relative movement of said support means with respect to a surface.

Figure 2:
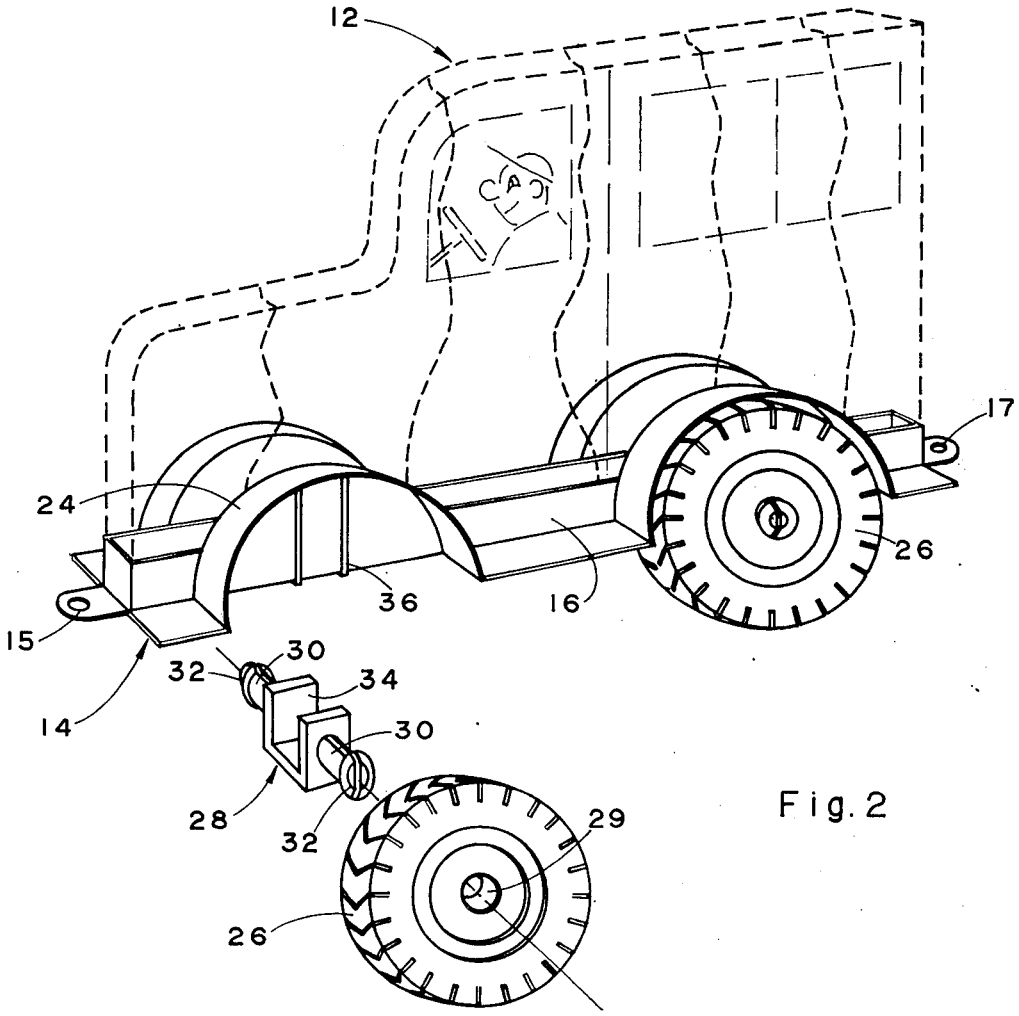

The invention will be more fully understood and appreciated from the following detailed description taken in conjunction with the drawing in which:

FIG. 1 shows puzzle pieces constructed and operative according to the invention in a spaced orientation; and FIG. 2 is a partially exploded view of a moving puzzle constructed and operative according to the invention.

Referring now to FIGS. 1 and 2 there is shown a moving puzzle comprising a plurality of puzzle pieces 10 which, when placed in juxtaposition in a predetermined, form a completed image 12 which may be that of a moving vehicle, animal or any other image. Puzzle pieces 10 may be conveniently formed of sheet plastic, wood, corrugated paper or any other suitable planar material. Preferably a material with good structural properties is employed in order to ensure the retention of the shape of the playing pieces even after considerable use.

Puzzle pieces 10 are of generally planar configuration and are generally constructed with curved or otherwise non-uniformly shaped edges thereby requiring a predetermined order of placement for there to be a tight fit. This type of puzzle construction is particularly desirable in the fabrication of games for young children where the juxtaposition of mating shapes assists the child to form the image. In an alternative embodiment of the invention the various puzzle pieces may be formed with either straight or curved edges and may fit together either in a unique or random manner. According to a further alternative embodiment of the invention a plurality of different desired patterns may be produced depending on the order of juxtaposition.

Puzzle pieces 10 are maintained in an upright orientation and in desired mating relationship by insertion of the puzzle pieces into a support member 14 which includes an elongate trough 16. The width of trough 16 is selected to be approximately equal to the thickness of the planar material from which the puzzle pieces are formed.

For the purposes of definition, the puzzle pieces 10 may be understood as comprising two regions, an upper region 18 which is visible above support member 14 and a lower anchor region 20 which is inserted into trough 16. The extent to which the anchor region 20 extends above the bottom edge of the puzzle pieces is approximately equal to the height of trough 16. More than one set of puzzle pieces may be interchangeably inserted into trough 16 to form a variety of images.

The length of trough 16 is selected to be approximately equal to the combined total lengths of the assembled puzzle pieces at anchor regions 20 when disposed in engaged mating relationship.

In summary the relationship between the dimensions of the trough and the combined dimensions of the puzzle pieces at their anchor regions are selected to permit ready insertion and removal of the puzzle pieces from the support member while providing sufficient support for the puzzle pieces, once inserted, both to enable a player such as a child sequentially to fit puzzle pieces without having the initially inserted puzzle pieces fall out prior to completion of the insertion of all the pieces and secondly to ensure that puzzle pieces do not inadvertently fall out of support member 14 when the entire puzzle is in motion.

Support member 14 may be configured in a variety of fanciful shapes such as to define fender 24 or any other members which might be associated with the image formed on the puzzle pieces. For example, where the completed puzzle depicts an animal, such member 14 may be configured in the form of leg members of such an animal.

Attachment members 15 and 17 may be provided at the respective front and back of support member 14. The attachment members may be apertured plates as shown, or alternatively one or both attachment members may comprise peg means insertable into a mounting aperture. Attachment members 15 and 17 may be conveniently used for attaching a tow string to the movable puzzle or for forming a plurality of moving puzzles together to form a train or a chain of movable puzzles.

Relatively free mobility of the puzzle on a generally smooth surface is provided by a plurality of rollers or wheels 26. Wheels 26 may be of any suitable type and conveniently attached onto support member 14 by means of mounting members 28 which extend through apertures 29.

Mounting members 28 as seen in FIG. 2 comprise first and second bifurcated axle portions 30 disposed adjacent opposite ends of support member 14. The axle portions terminate in retaining members 32 such as discs or cones which prevent inadvertent detachment of the wheel from the mounting member.

According to a preferred embodiment of the invention the wheels are mounted on members 28 by forcing them over retaining discs 32 resulting in compression of the bifurcated axle portions. Once the wheel clears the retaining member the axle portions return to their normal separated rest position and the wheel is prevented from inadvertent disengagement.

Mounting members 28 are either fixedly or removably attached to support member 14 by insertion of a U-shaped bracket portion 34, formed intermediate the two axle portions, onto the outer surface of trough 16 of support member 14. Where it is desired to removably attach the mounting member onto support member 14, protrustions 36 may be provided on the outer wall portions of trough 16 to define the desired position of the mounting members. In the alternative where it is desired to permanently mount the mounting members onto the support members, a suitable type of adhesive may be employed or the mounting member may be formed integrally with member 14.

It will be appreciated by those skilled in the art that the present invention may be embodied in a wide variety of forms, styles and designs without departing from the invention. Therefore the invention is defined only by the claims which follow:

I claim:

1. A movable puzzle comprising:

a plurality of puzzle elements each having a top and a bottom portion and having a substantially planar configuration and length and height dimensions substantially greater than its thickness and together forming an image on at least one planar face of the top portion thereof when juxtaposed in a desired relative generally planar orientation;

means for mounting said puzzle pieces in upstanding orientation and in desired juxtaposition and spatial relationship so as to permit movement of the puzzle pieces as a whole, said means including:

an elongate trough formed of:

generally parallel disposed first and second side members spaced apart separated by a distance approximately equal to the thickness of the planar puzzle pieces; and end pieces joining said side members to define a trough length approximately equal to the overall length of the bottom portions of the juxtaposed puzzle pieces, said trough being operative to provide upright support and maintenance in juxtaposition of said puzzle pieces inserted therein; and translation means permitting relative movement of said support means with respect to a surface;

said mounting means being configured in a design which together with said image forms a composite representation.

2. A movable puzzle according to claim 1 wherein said plurality of puzzle elements are configured so as to be arrangeable in a unique juxtaposition to form said image.

3. A movable puzzle according to claim 1 wherein said puzzle elements when juxtaposed form images on the two opposite planar faces thereof.

4. A movable puzzle according to claim 1 wherein said translation means comprises:

a plurality of wheels;

a plurality of combined axle and mounting members mounted on said elongate trough and providing a rotatable mounting for a pair of said wheels.

5. A movable puzzle according to claim 4 wherein said combined mounting and axle members comprise bifurcated axle elements permitting removable snap action mounting of said wheels onto said combined mounting members.

6. A movable puzzle according to claim 4 wherein said combined mounting and axle members each comprise a U-shaped central portion which fits over said trough and said elongate trough is additionally formed with a plurality of locating protrusions which engage said central portion and define desired locations for said combined mounting members on said elongate trough.

7. A movable puzzle in accordance with claim 1 wherein said plurality of puzzle elements comprise a plurality of sets of puzzle elements which may be interchangeably inserted into said trough to form a variety of images.

* * * * *